US011648771B2

(12) United States Patent
Mawatari

(10) Patent No.: US 11,648,771 B2
(45) Date of Patent: May 16, 2023

(54) INKJET RECORDING DEVICE AND INKJET HEAD DRIVE METHOD

(71) Applicant: Konica Minolta, Inc., Tokyo (JP)

(72) Inventor: Kenji Mawatari, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 217 days.

(21) Appl. No.: 16/960,207

(22) PCT Filed: Oct. 4, 2018

(86) PCT No.: PCT/JP2018/037150
§ 371 (c)(1),
(2) Date: Jul. 6, 2020

(87) PCT Pub. No.: WO2019/135305
PCT Pub. Date: Jul. 11, 2019

(65) Prior Publication Data

US 2021/0094290 A1 Apr. 1, 2021

(30) Foreign Application Priority Data

Jan. 5, 2018 (JP) ..... JP2018-000413

(51) Int. Cl.
*B41J 2/045* (2006.01)

(52) U.S. Cl.
CPC ..... *B41J 2/04588* (2013.01); *B41J 2/0459* (2013.01); *B41J 2/04586* (2013.01); *B41J 2/04591* (2013.01)

(58) Field of Classification Search
CPC ..... B41J 2/04588; B41J 2/04516; B41J 2/04581; B41J 2/0459; B41J 2/04591; B41J 2/04593; B41J 2/04595; B41J 2/2128
See application file for complete search history.

(56) References Cited

U.S. PATENT DOCUMENTS

2012/0218333 A1* 8/2012 Nishikawa ..... B41J 2/04581 347/10
2015/0251414 A1* 9/2015 Araki ..... B41J 2/04588 347/10

FOREIGN PATENT DOCUMENTS

JP 4117162 B2 4/2008
JP 2010149335 A * 7/2010
(Continued)

OTHER PUBLICATIONS

Satoru, MachineTranslationofJP-2010149335-A, 2010 (Year: 2010).*
Koda, MachineTranslationofJP-2010149335-A, 2010 (Year: 2010).*
(Continued)

*Primary Examiner* — Scott A Richmond
(74) *Attorney, Agent, or Firm* — Cantor Colburn LLP

(57) ABSTRACT

The present invention discharges ink from a plurality of inkjet heads and is used when performing drive whereby one droplet or a plurality of droplets are discharged onto and united on one pixel. A drive signal includes a drive waveform comprising N number (N being an integer of at least 2) of drive waveform elements and is configured so as to fulfil the relationship 1.1 Tc≤Ts≤1.4 Tc, when Tc is the natural vibration cycle determined from the inkjet head structure and Ts is the time from the start point of the drive waveform to the start point of the subsequent drive waveform. As a result, velocity deviation caused by the resonant frequency of a piezoelectric actuator driving the inkjet head can be suppressed when driving an inkjet head using multiple gradations.

6 Claims, 9 Drawing Sheets

(56) References Cited

FOREIGN PATENT DOCUMENTS

| | | |
|---|---|---|
| JP | 2010149335 A | 7/2010 |
| JP | 2014148110 A | 8/2014 |

OTHER PUBLICATIONS

EPO Extended European Search Report for corresponding EP Application No. 18897885.2; dated Jan. 27, 2021.
International Search Report for International Application No. PCT/JP2018/037150, dated Dec. 4, 2018.

* cited by examiner

INKJET RECORDING DEVICE AND INKJET HEAD DRIVE METHOD

CROSS REFERENCE TO RELATED APPLICATIONS

This is the U.S. national stage of application No. PCT/JP2018/037150, filed Oct. 4, 2018. Priority under 35 U.S.C. § 119(a) and 35 U.S.C. § 365(b) is claimed from Japanese Application No. 2018-000413, filed Jan. 5, 2018, the disclosure of which is also incorporated herein by reference.

TECHNOLOGICAL FIELD

The present invention relates to an inkjet recording device and an inkjet head drive method.

BACKGROUND ART

Inkjet recording devices which discharge ink from a nozzle and let the ink impact on a medium to record an image have been developed and commercialized.

In inkjet recording devices, usually shades are expressed according to the ink-coated area per unit area. As one method for controlling the ink-coated area, the method which changes the liquid amount per ink droplet is known.

In order to change the liquid amount per ink droplet adequately, for example, the discharge timing and speed of a plurality of droplets discharged by a plurality of consecutive liquid discharge motions are adjusted so that the droplets are united before impacting on the medium to obtain a single droplet the liquid amount of which corresponds to the number of original droplets. By adjusting the liquid amount according to the number of original droplets, shading, namely gradation (tone) is expressed. However, one problem is that when droplet discharge motions are continued, it may happen that unwanted microdroplets (satellites) are generated due to the influence of preceding liquid discharge motions and the microdroplets impact on the medium and deteriorate the quality of recording.

Patent Literature 1 describes a technique that suppresses variation in the discharge speed of ink droplets discharged from a nozzle and the droplet amount by setting the variable for expanding or contracting an entire multi-tone waveform so that the discharge speed obtained with the waveform is at peak. By adopting the technique described in Patent Literature 1, the quality of recording can be improved even if the resonance frequency varies among the piezoelectric actuators for driving the inkjet heads.

CITATION LIST

Patent Literature

Patent Literature 1: Japanese Patent No. 4117162

SUMMARY OF INVENTION

Technical Problem

The technique described in Patent Literature 1 works relatively effectively when the number of tones is small. However, in the case of a multi-tone waveform for many tones (for example, a multi-tone waveform for five or more tones), variation in resonance frequency causes the speed peak value to change. Therefore, a problem for multi-tone waveforms is that the velocity variation caused by resonance variation among channels cannot be suppressed even if the waveform generation frequency set for a reference channel is used.

The present invention has an object to suppress the velocity deviation caused by variation in resonance frequency among piezoelectric actuators for driving inkjet heads when driving the inkjet heads for multiple tones (gradations) and thereby improve the quality of recording.

Solving Means

The inkjet recording device according to the present invention includes: a plurality of inkjet heads having a nozzle for discharging ink; a plurality of actuators which give a pressure change to the ink in the plural inkjet heads by a prescribed drive operation; and a drive section which generates a drive signal to discharge one droplet or discharge and unite a plurality of droplets for one pixel and applies the drive signal to each of the plural actuators.

Here, the drive signal generated by the drive section includes a drive waveform comprising N number (N being an integer of at least 2) of drive waveform elements, and when Tc is the natural vibration cycle determined from the inkjet head structure, time Ts from the start point of the drive waveform to the start point of the subsequent drive waveform fulfills the relationship $1.1 \leq Tc \leq Ts \leq 1.4Tc$.

In addition, the inkjet head drive method according to the present invention is an inkjet head drive method in which a plurality of actuators give a pressure change to ink by a prescribed drive signal so that a plurality of inkjet heads discharge the ink and the plural actuators are driven to discharge one droplet or discharge and unite a plurality of droplets for one pixel.

Here, the drive signal includes a drive waveform comprising N number (N being an integer of at least 2) of drive waveform elements, and when Tc is the natural vibration cycle determined from the inkjet head structure, time Ts from the start point of the drive waveform to the start point of the subsequent drive waveform fulfills the relationship $1.1 \leq Tc \leq Ts \leq 1.4Tc$.

DETAILED DESCRIPTION OF EMBODIMENTS

Next, an embodiment of the present invention will be described.

[1. Structure of the Recording Device]

Figure 1:
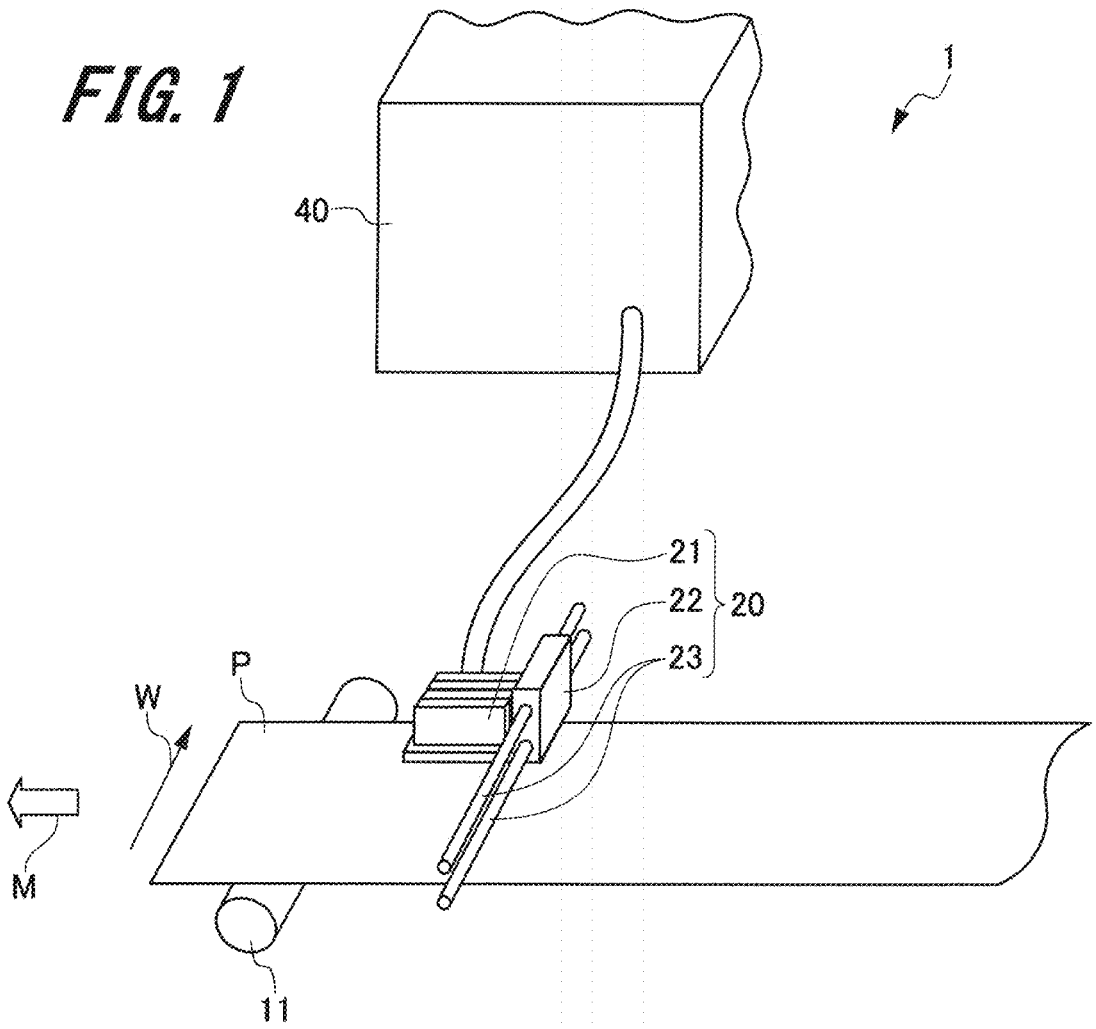
FIG. 1 is a perspective view which shows the general structure of the main part of an inkjet recording device according to an embodiment of the present invention.

FIG. 1 is a perspective view which schematically shows the general structure of an inkjet recording device 1 according to the embodiment.

The inkjet recording device 1 performs the recording process to record an image or the like on a recording medium P with ink. The recording medium P is conveyed by a drive roller 11. In order to simplify the explanation, FIG. 1 shows only one drive roller 11, though a plurality of rollers are disposed in the actual inkjet recording device 1.

A recording section 20 includes a recording head 21, a carriage 22, and carriage rails 23.

The recording head 21 discharges ink and lets it impact on the recording medium P. In this case, four recording heads 21 which discharge four colors CMYK (cyan, magenta, yellow, black) are provided. These four recording heads 21 are arranged in the width direction perpendicular to the conveying direction of the recording medium P and attached to the carriage 22. The surface of the recording head 21 which faces the recording medium P is an ink discharge surface in which openings of nozzles 212 (FIG. 2) (nozzle openings) are arranged, and ink is discharged from a nozzle opening almost perpendicularly to the recording medium P and impacted on the recording medium P.

Figure 2:
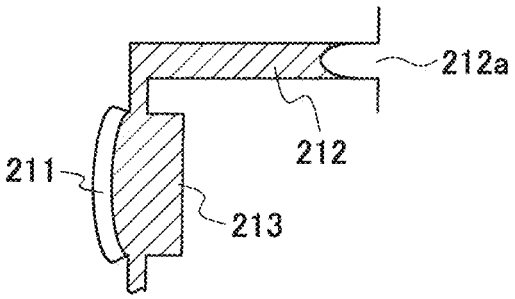
FIG. 2 is a sectional view which shows an example of an inkjet head according to the embodiment of the present invention.

FIG. 2 is a sectional view which shows the general structure of an inkjet head.

The recording head 21 includes: a nozzle 212 which discharges ink through an opening 212*a* at the tip; an ink flow path 213 including a pressure chamber communicated to the nozzle 212; and an actuator 211 which deforms the pressure chamber. The actuator 211 is constituted by a piezoelectric element which is deformed depending on voltage.

The actuator 211 has the same polarity as reference voltage and when a voltage change toward a lower voltage is applied, it is deformed in a direction to expand the pressure chamber (increase the volume) so that the ink is drawn and flowed into the pressure chamber. Then, as the voltage applied to the actuator 211 returns to the reference voltage, the actuator 211 is restored from the deformed state so that the volume of the pressure chamber is decreased and the ink is pushed out and discharged from the nozzle 212.

In the recording heads 21 according to this embodiment, a plurality of nozzles 212, a plurality of ink flow paths 213, and a plurality of actuators 211 are arranged as shown in FIG. 2 so that the ink is efficiently discharged toward the recording medium P using the plural nozzles 212.

Referring back to FIG. 1, the carriage 22 holds the recording heads 21 and moves along the carriage rails 23 in the width direction.

The carriage rails 23 are two parallel rails (one pair) which extend beyond the maximum recordable width along the direction intersecting with the conveying direction, in this case, along the width direction. The carriage rails 23 support the carriage 22 in a manner to enable the carriage 22 to move in the width direction. The movement of the carriage 22 is made, for example, by a linear motor. The position of the carriage 22 on the carriage rails 23 (position in the scanning direction) is detected by a linear encoder (not shown) and the detection result is sent to a controller 40.

The controller 40 controls the conveyance of the recording medium P by a conveyor 10, the movement (scanning) of the recording heads 21 in the width direction and the ink discharge timing to control the operation of image recording on the recording medium P. In short, in the inkjet recording device 1, scanning operation to move the recording heads 21 in the width direction and conveying operation to move the recording medium P in the conveying direction are combined to form a two-dimensional image.

Figure 3:
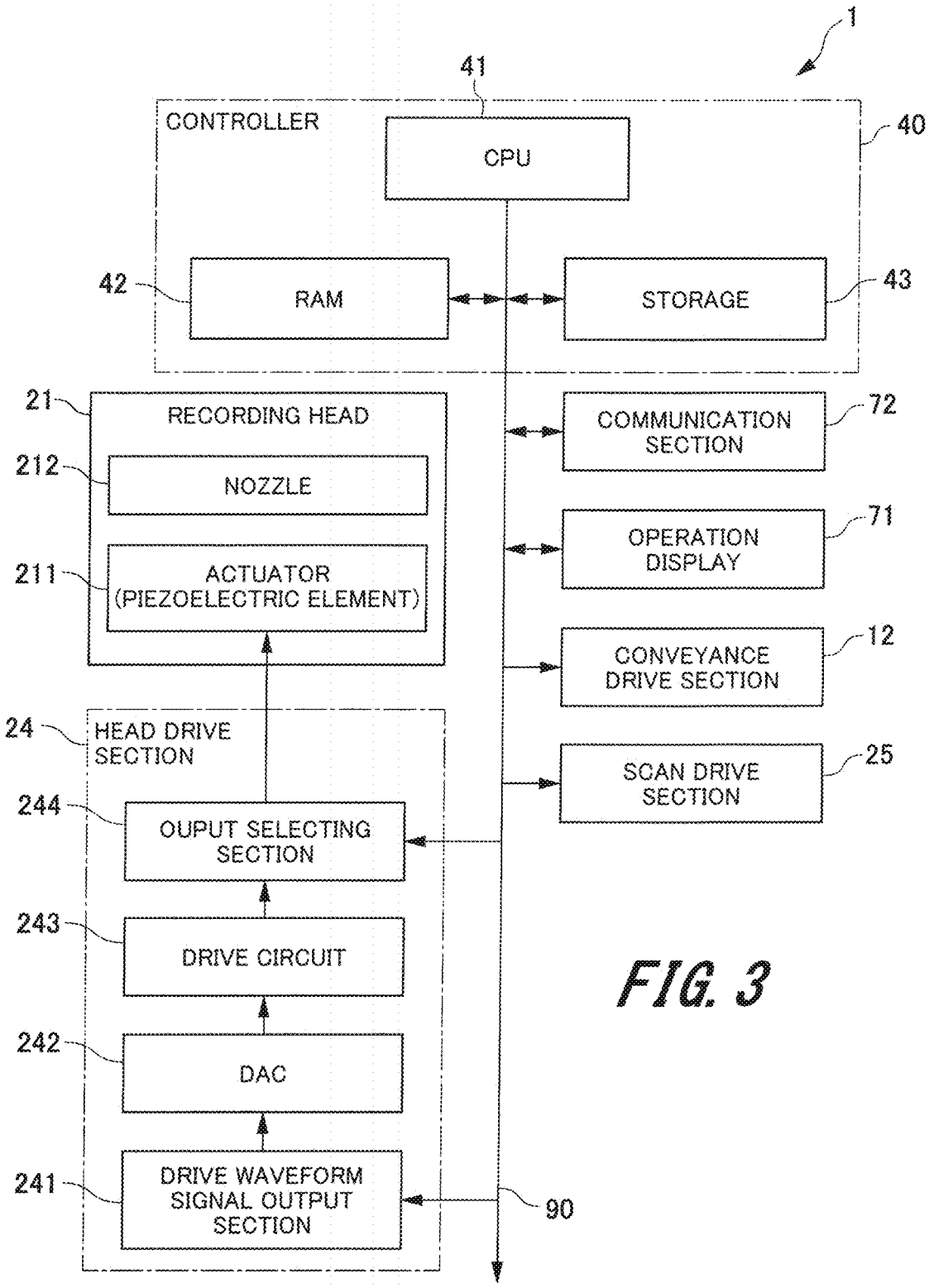
FIG. 3 is a block diagram which shows an example of the structure of the inkjet recording device according to the embodiment of the present invention.

FIG. 3 is a block diagram which shows the functional structure of the inkjet recording device 1 according to this embodiment.

The inkjet recording device 1 includes the controller 40, a conveyance drive section 12, the recording head 21, a head drive section 24, a scan drive section 25, an operation display 71, a communication section 72, and a bus 90.

The head drive section 24 sends a drive voltage signal for each nozzle of the recording head 21 to discharge ink at an adequate timing, to the actuator 211 for the selected nozzle 212 to activate the actuator 211. The head drive section 24 includes a drive waveform signal output section 241, a digital/analog converter (DAC) 242, a drive circuit 243, and an output selecting section 244.

The drive waveform signal output section 241 outputs digital data for the drive waveform depending on ink discharge or non-discharge (including discontinuation or end of image recording) in synchronization with a clock signal from an oscillation circuit (not shown). The digital/analog converter (DAC) 242 converts the digital data drive waveform into an analog signal and outputs it as an input signal Vin to the drive circuit 243.

The drive circuit 243 amplifies the input signal Vin to a voltage value according to the drive voltage for the actuator 211. Furthermore, the drive circuit 243 outputs an output signal Vout, the current of which is amplified according to the current flowing through the actuator 211 (electrodes at both ends), through the output selecting section 244.

The output selecting section 244 outputs a selection signal which selects the actuator 211 to which the output signal Vout should be sent, according to the pixel data of the image as the object of formation which is entered from the controller 40.

In the recording head 21, the actuator 211 is deformed according to the drive voltage signal from the drive circuit 243 of the head drive section 24. Inks are discharged from a plurality of nozzles according to the deformation of the actuator 211 and ink droplets impact on the positions on the recording medium P which depend on the operation of the conveyance drive section 12 and the scan drive section 25.

The conveyance drive section 12 gets the recording medium P before image recording, from the medium supply section and brings it so that an adequate position of it faces the ink discharge surface of the recording head 21 and takes the recording medium P on which the image has been recorded, out of the position facing the ink discharge surface. The conveyance drive section 12 rotates the motor for rotating the drive rollers 11 at an adequate speed and an adequate timing.

The scan drive section 25 moves the carriage 22 to an adequate position along the width direction. The scan drive section 25 rotates the motor for moving the abovementioned endless belt cyclically at an adequate timing and an adequate speed.

The operation display 71 displays status information and a menu which are related to image recording and also accepts an input operation from the user. For example, the operation display 71 includes a liquid crystal display panel and a touch panel placed over the liquid crystal screen and sends an operation detection signal depending on the position of the touch operation made by the user and the type of operation, to the controller 40. The operation display 71 further includes an LED (Light Emitting Diode) lamp and a pushbutton switch which are used for an alarm display or for indication and operation of the main power source.

The communication section 72 performs reception and transmission of data with the outside in accordance with a prescribed telecommunication standard.

As the telecommunication standard, various known methods, including TCP/IP connection for telecommunication using a LAN (Local Area Network) cable, wireless LAN (IEEE802.11), near field wireless communication (IEEE802.15) such as Bluetooth (registered trademark) and USB (Universal Serial Bus) connection, are used. The communication section 72 has hardware such as a connection terminal which conforms to the usable telecommunication standard and a network card which makes a communication according to the telecommunication standard.

The controller 40 controls the overall operation of the inkjet recording device 1. The controller 40 includes a central control unit (CPU: Central Processing Unit) 41, a RAM (Random Access Memory) 42, and a storage 43. The CPU 41 performs various arithmetic operations related to the integrated control of the inkjet recording device 1. The RAM 42 gives the CPU 41 a memory space for working and stores temporary data. The storage 43 stores the control program to be executed by the CPU 41 and setting data and temporarily stores the data of the image to be formed. The storage 43 includes a volatile memory such as a DRAM and a nonvolatile storage medium such as an HDD (Hard Disk Drive) or flash memory and selectively uses them according to the application purpose.

The bus 90 is a communication path which connects these constituent elements to transmit and receive data.

Here, although the scan type inkjet recording device 1 which uses the recording head 21 for scanning has been described as an example, instead a line head may be used as the recording head 21 so that a two-dimensional image is recorded simply by moving the recording medium P in the conveying direction with respect to the fixed recording head 21.

[2. Ink Discharge Motion]

Next, the ink discharge motion in the inkjet recording device 1 according to this embodiment will be explained. As already explained, in the inkjet recording device 1, after the head drive section 24 makes the actuator 211 expand (increase in volume) the ink flow path 213 (pressure chamber), the ink is discharged by the drive operation to deform the expanded flow path to restore its original form. This deformation by the actuator 211 is made by once lowering the drive voltage applied to the actuator 211 as a piezoelectric element to below the reference voltage and keeping the voltage and then increasing the voltage up to the original reference voltage.

In the inkjet recording device 1, as for a unit discharge amount equivalent to a normal droplet, a multiple (prescribed number not smaller than 2) of the unit discharge amount can be discharged. In the case of this embodiment, multiple tone discharge motion to discharge at most 6 times as large as the unit discharge amount can be made.

In the inkjet recording device 1, a series of drive operations to apply a prescribed drive waveform voltage continuously at prescribed cycle time intervals are performed so that the ink which has been pushed out generates a plurality of ink liquid masses which are not separated from the ink inside the ink flow path but continuous with it. Then, after these are separated from the ink inside the ink flow path 213, these ink liquid masses are united into a single ink droplet having a total liquid amount (liquid amount corresponding to the number of drive operations), which impacts on the recording medium.

Here, the cycle time is set in the range in which ink liquid masses flying out of the nozzle opening can be generated and finally separated as an ink droplet and the liquid masses can be united. In addition, the voltage waveform cycle time is determined so that in a plurality of inkjet heads (channels), the variation in natural vibration cycle Tc among the channels is absorbed and speed variation in the head surface and among the heads is 7% or less. To make the variation 7% or less means that in the standard inkjet printer specification, the variation should be not more than the half pixel in 600 dpi.

Furthermore, the amplitude of each drive waveform voltage is adjusted so that the ink droplet speed after uniting the ink liquid masses is uniform regardless of the ink droplet liquid amount, namely the number of applications of the drive waveform voltage to the actuator 211, and the timing of the last application of the drive waveform voltage is determined according to the ink discharge timing, namely the timing of ink impacting on the recording medium P. If the ink droplet liquid amount is two or more prescribed number of times the unit discharge amount, the prescribed drive waveform voltage is added before the drive waveform voltage signal in the last cycle and then the drive waveform voltage in the total number of cycles is applied to the actuator 211. The prescribed number of times here need not be an exact value. In other words, some error is allowable as far as the discharged ink causes no problem in the image density.

As mentioned above, ink droplets can be discharged in six steps of liquid amount and as a time which allows drive operation to perform this, the time of six cycles (time which allows two or more prescribed number of times of drive operation) is reserved in advance for each discharge motion for one ink droplet. Consequently, ink discharge motion can be made in uniform cycles which correspond to the time of six cycles. In the head drive section 24, the output selecting section 244 selects whether or not to perform drive operation at each timing in the six cycles according to the density tone data entered for each pixel position from the storage 43 so that the corresponding amount of ink is discharged and impacted on the pixel position concerned.

FIG. 4A to FIG. 4F of show examples of drive waveform voltage signals which are applied to the actuator 211 for one to six times the unit discharge amount.

Figure 4A:
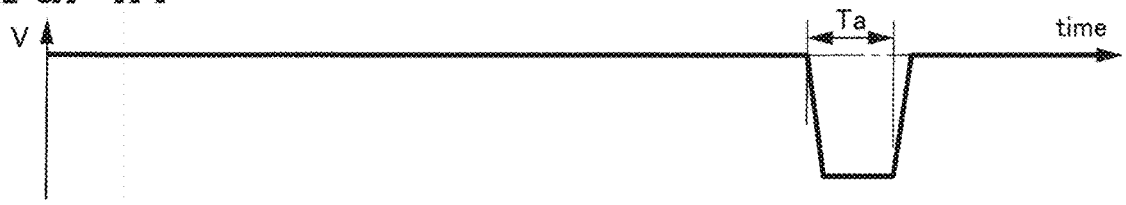
FIG. 4A to FIG. 4F are waveform diagrams which show examples of drive waveform according to the embodiment of the present invention.

FIG. 4A shows a drive waveform voltage signal in the case that the drive waveform voltage is applied to the actuator 211 only once so that the liquid, the amount of which is one time the unit discharge amount, is discharged and impacted. Time period Ta of the drive waveform voltage signal denotes time from the fall start of the voltage to the rise start.

Figure 4B:
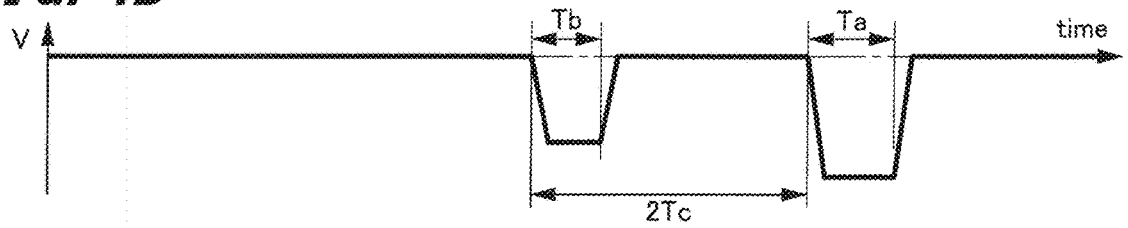

FIG. 4B shows a drive waveform voltage signal in the case that the drive waveform voltage is applied to the actuator 211 twice so that the liquid, the amount of which is twice the unit discharge amount, is discharged and impacted (in the case that the number of operations is 2).

Here, as shown in FIG. 4B, the head drive section 24 is made to perform drive operation to output the first drive waveform voltage signal two cycle times 2Tc (time period of twice the cycle time Tc) before output timing of the last drive waveform voltage signal.

FIG. 4C, FIG. 4D, FIG. 4E, and FIG. 4F show drive waveform voltage signals in the case that the drive waveform voltage is applied to the actuator 211 three times, four times, five times, and six times so that the liquid, the amount of which is three times, four times, five times, and six times the unit discharge amount, is discharged and impacted, respectively.

When a plurality of operations are performed, the time period from the fall start of the voltage to the rise start except the last drive waveform voltage signal is expressed by Tb. The potential which decreases in each time period Tb is set to a smaller value than the potential which decreases in the time period Ta of the last drive waveform voltage signal. The reason that the potential of the last drive waveform voltage signal is larger than the potential of the drive waveform voltage signals in the other time periods is that only for the last ink pushing timing, the time length from the fall start to the rise start is adjusted according to the actual ink vibration phase more adequately.

FIG. 5A to FIG. 5F schematically shows the ink liquid surface in the vicinity of the nozzle opening at the time of ink discharge. For easy understanding of the explanation, in these figures, the relation between the sizes of an ink liquid mass and an ink droplet and the size of an ink liquid column does not accurately reflect the actual ratio.

Figure 5A:
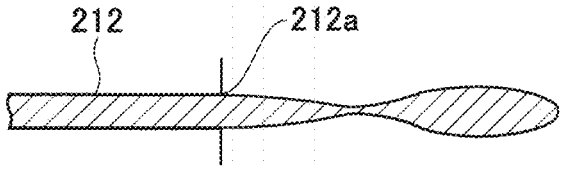
FIG. 5A to FIG. 5F are sectional views which show examples of ink droplet conditions according to the embodiment of the present invention.

As the actuator 211 is deformed with the first voltage drop in the drive waveform voltage, the ink flow path 213 (pressure chamber) expands and the ink liquid surface (meniscus surface) inside the nozzle 212 is pulled more inward than the nozzle opening. Then, with the voltage rise (restoration to the original voltage), as shown in FIG. 5A, the ink liquid surface inside the nozzle 212 flies out of the nozzle opening 212*a*. Due to the ink viscosity and the friction depending on the nozzle shape, this timing (phase of ink liquid surface vibration) delays from the timings of natural vibration cycle phases 0 and $\pi$ related to pressure vibration of the ink inside the nozzle in reference to the voltage drop start time slightly, specifically approximately 0.05 to 0.20 time the natural vibration cycle of the ink inside the ink flow path 213 and nozzle 212 (phase difference of approximately $\pi/10$ to $2\pi/5$).

Figure 5B:
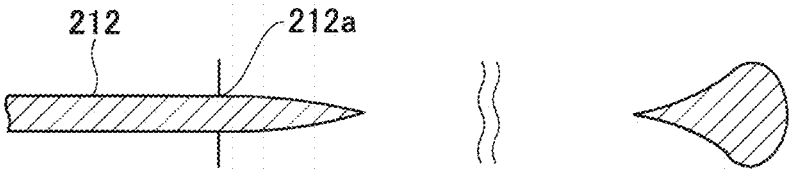

At this time, the ink which has flied out of the opening 212*a* of the nozzle 212 is not separated from the ink inside the nozzle 212 but becomes an ink liquid mass connected with the ink inside the nozzle 212 as an ink liquid column. After approximately three cycle time periods have elapsed from the start timing of output of the last drive waveform voltage signal, the ink liquid mass is separated from the ink inside the nozzle 212 and becomes an ink droplet as shown in FIG. 5B.

Figure 5C:
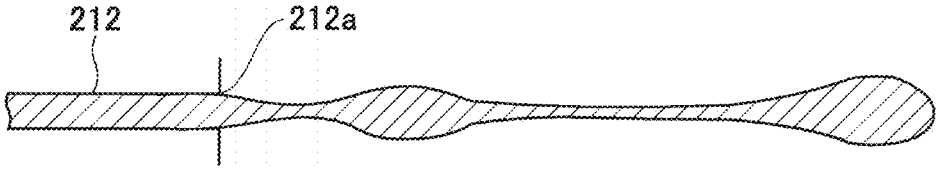
Figure 5D:
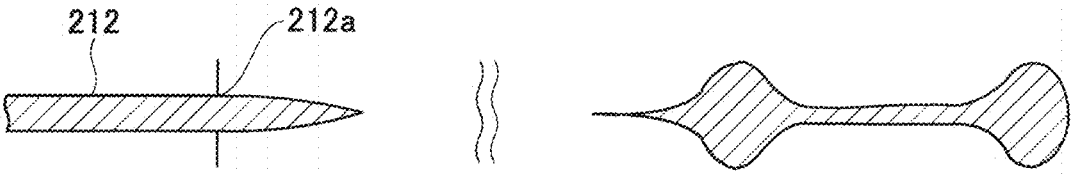

When an ink droplet the amount of which is twice the unit discharge amount is discharged, as explained in reference to FIG. 4B, a second drive waveform voltage signal is applied to the actuator 211 after two cycle time periods have elapsed from the start of output of a first drive waveform voltage signal. Consequently, an ink liquid column with two ink liquid masses spaced and connected with each other is generated from the opening 212*a* of the nozzle 212 as shown in FIG. 5C. These two ink liquid masses are separated from the ink inside the nozzle 212 and thus an ink droplet, the amount of which is twice the unit discharge amount, is discharged as shown in FIG. 5D. The separated ink droplet is more integrated (namely united) due to the viscosity (surface tension), etc. and flies and impacts on the recording medium P. The root part of the ink liquid column which is separated from the ink droplet is pulled back into the nozzle 212 according to the ink viscosity (force of retraction into the nozzle 212 due to reverberation vibration).

At this time, a reverberation vibration is superimposed on the vibration with the last (second) drive waveform voltage signal. When the amplitude of the reverberation vibration is larger, the speed of the ink liquid mass flying from the nozzle opening 212*a* at the last time (second time) is higher. The easiness to generate satellites as unwanted microdroplets depends on the ejection speed of the last ink liquid mass, namely the length of the tail of the ink liquid mass until its separation from the ink inside the nozzle 212.

As shown in FIG. 4B, when the drive waveform voltage signal outputted at the timing after the elapse of the two cycle time periods is inputted to the actuator 211, the reverberation vibration is damped according to the interval equivalent to one cycle time period and thus generation of satellites is suppressed according to the damping of the reverberation vibration.

Figure 4C:
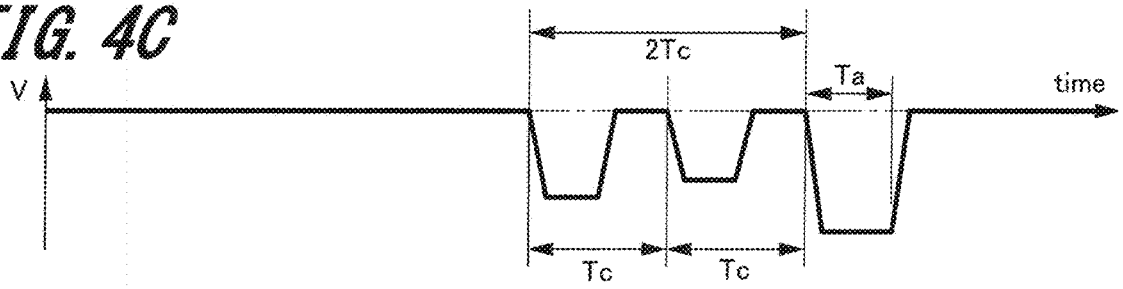
Figure 4D:
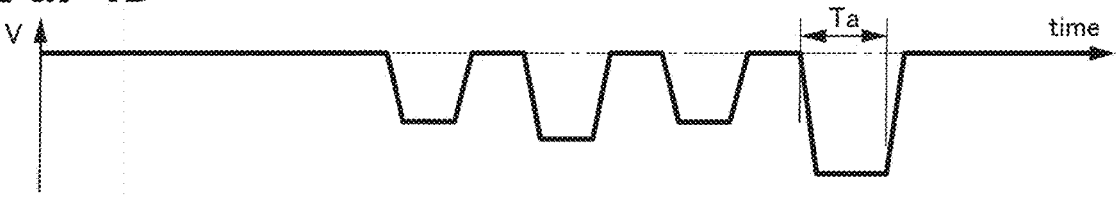
Figure 4E:
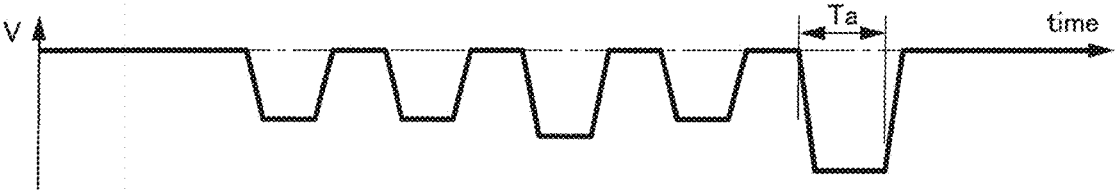
Figure 4F:
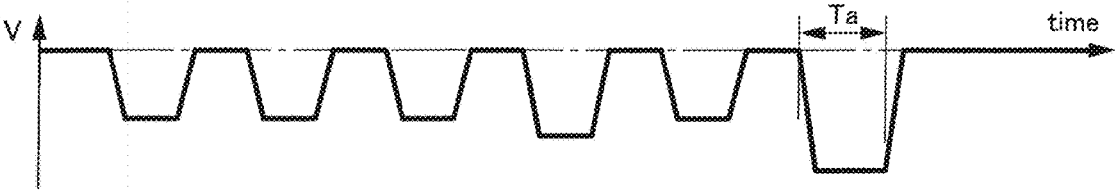
Figure 5E:
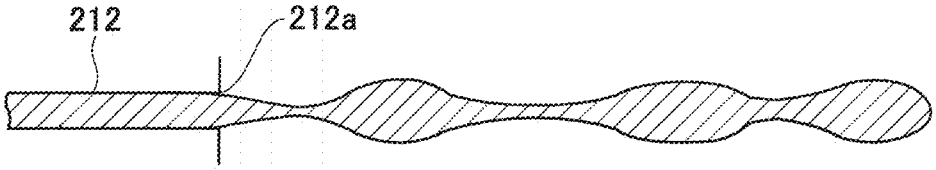
Figure 5F:
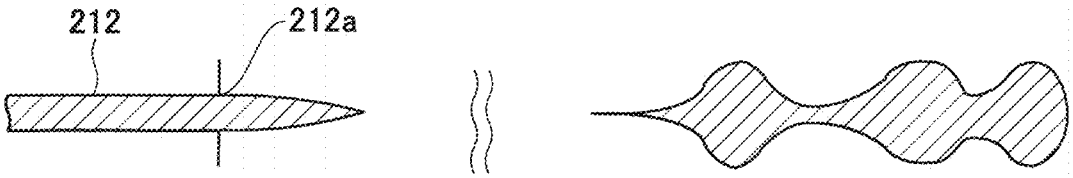

When an ink droplet the amount of which is three times the unit discharge amount is discharged, as shown in FIG. 4C, three drive waveform voltage signals are inputted to the actuator 211 consecutively in three cycles. Consequently, an ink liquid column as a series of three ink liquid masses is generated from the opening 212*a* of the nozzle 212 as shown in FIG. 5E. Then, as shown in FIG. 5F, these are separated from the ink inside the nozzle 212 and an ink droplet the amount of which is three times the unit discharge amount is discharged.

When an ink droplet the amount of which is three times the unit discharge amount is discharged, the ratio of the liquid amount of the last ink liquid mass (namely, the unit discharge amount) is small in comparison with the total liquid amount of the preceding ink liquid masses. Consequently, in comparison with the case that an ink droplet the amount of which is twice the unit discharge amount is discharged as mentioned above, the last ink liquid mass is more effectively pulled toward the preceding ink liquid masses. On the other hand, the vibration of ink on the nozzle 212 side is larger and thus the force of pulling into the nozzle 212 is also larger. Therefore, even if the speed of the last ink liquid mass somewhat increases, only the ink droplet can be easily separated without generation of satellites.

When an ink droplet the amount of which is four or more times the unit discharge amount is discharged, the total liquid amount of the preceding ink liquid masses further increases and thus generation of satellites is suppressed more effectively.

When an ink droplet the amount of which is two or more times the unit discharge amount is discharged, for the drive waveform voltage signals except the last drive waveform voltage signal, the time period Ta from the fall start of the voltage to the rise start is half of the natural vibration cycle Tc (Tc/2). Also, for the last drive waveform voltage signal (drive operation for the last droplet), the time period Ta from the fall start of the voltage to the rise start is longer than half of the natural vibration cycle Tc or 0.55 to 0.70 Tc. When this value 0.55 to 0.70 Tc is expressed by AL (Acoustic Length: equal to half of the natural vibration cycle Tc) which indicates the transmission time related to liquid surface vibration, it is 1.1 to 1.4 times the time period Ta. This corresponds to delaying the rise start of the voltage by the magnitude (delay time) corresponding to the actual phase delay of ink vibration (displacement) with respect to the timing of application of drive waveform voltage (drive operation).

As mentioned above, in order to prevent deterioration in image quality, the cycle time to which each waveform element is applied must be set so that even if the natural vibration cycle Tc varies among individual channels, the speed difference among the channels is 7% or less. Here, in this embodiment, the cycle time Ts is 1.1 or more times the natural vibration cycle Tc, so that the speed difference for the maximum gradation of 6 dpd can be 7% even for a channel with a deviation of about 5% in the natural vibration cycle Tc.

Therefore, it is preferable that the cycle time Ts should be 1.1 or more times the natural vibration cycle Tc.

On the other hand, as the cycle time Ts is increased, the difference from the resonance is larger and thus the drive efficiency declines and the droplets discharged by the waveform elements cannot be united. Therefore, it is preferable that the cycle time Ts should be not more than 1.4 times the natural vibration cycle Tc.

Figure 6A:
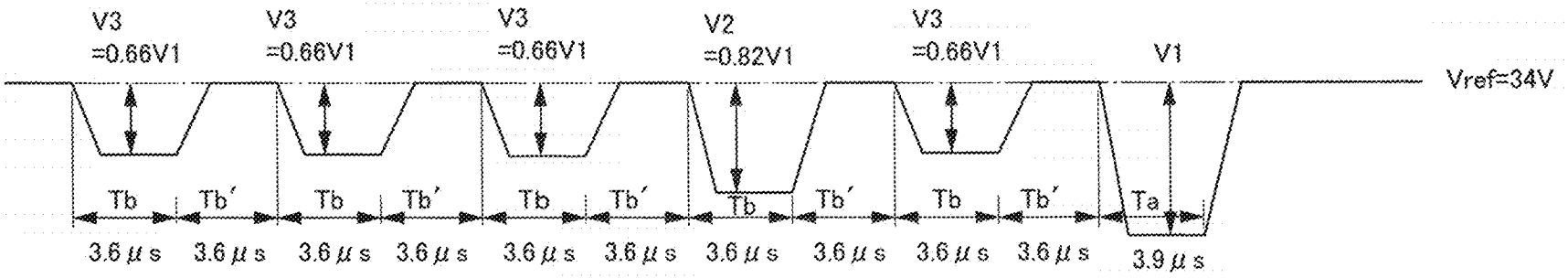
FIG. 6A and FIG. 6B are waveform diagrams which show examples of drive waveform (FIG. 6A) according to the embodiment of the present invention and a comparative example (FIG. 6B).
Figure 6B:
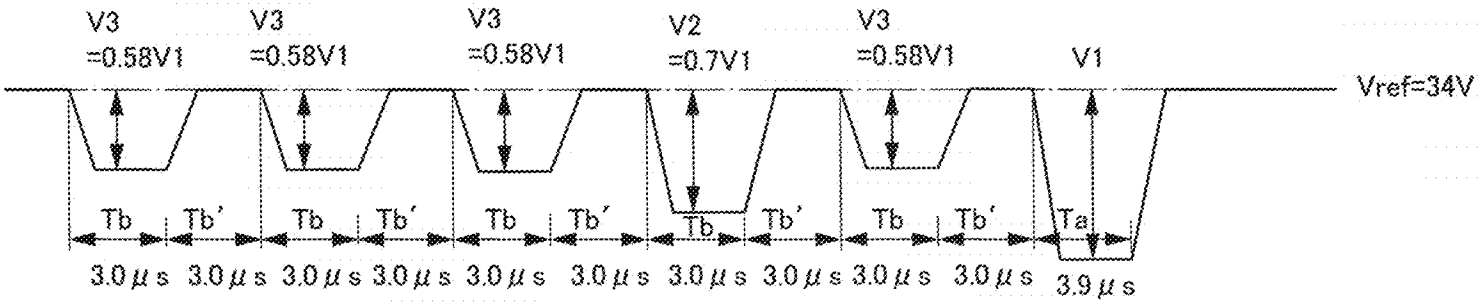

FIG. 6A and FIG. 6B show examples of the drive waveform voltage signal which the head drive section 24 having performed the abovementioned process supplies to the actuator 211 of each channel.

FIG. 6A shows a drive waveform voltage signal in this embodiment and FIG. 6B shows a comparative example (conventional example).

Here, reference voltage Vref is set at 34 V.

The drive waveform voltage signal in FIG. 6A is for drive of six cycles (six droplets).

Furthermore, the cycle time Ts (sub drop cycle) is determined by adding the above time Tb to the time Tb' from the pulse rise start timing of each cycle to the next pulse fall start timing. In the example in FIG. 6A, with Ta=3.9 μs, Tb=3.6 μs and Tb'=3.6 μs, only the last pulse time Ta is longer.

Also, in FIG. 6A, value V1 is the potential at which the pulse in the last cycle decreases, value V2 is the potential at which the pulse two cycles before the last one decreases, and value V3 is the potential at which the pulse in the other cycles (one cycle before, three cycles before, four cycles before and five cycles before the last) decreases.

Here, the potential V2 is 0.82 time the potential V1 and the potential V3 is 0.66 time the potential V1.

FIG. 6B is an example of the drive waveform voltage signal as the conventional drive waveform voltage signal which is shown for comparison with FIG. 6A.

In the case of the drive waveform voltage signal shown in FIG. 6B for which the process according to this embodiment is not performed, Ta=3.9 μs, Tb=3.0 μs, and Tb'=3.0 μs. In addition, the pulse potential V2 is 0.7 time the potential V1 and the potential V3 is 0.58 time the potential V1. In the example shown in FIG. 6B, the sub drop cycle Ts coincides with the natural vibration cycle Tc.

Figure 7:
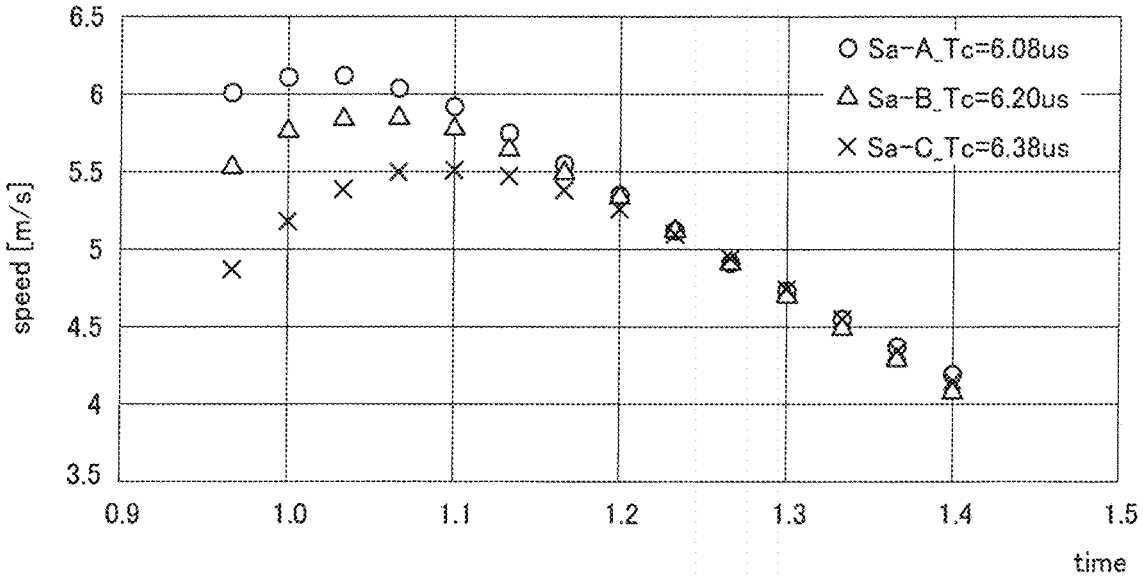
FIG. 7 is a characteristic graph which shows an example of the relationship between droplet speed and sub drop cycle, according to the embodiment of the present invention.

FIG. 7 is an example of measurement of the relationship between sub drop cycle Ts and droplet speed for three channels (samples A, B, and C). In FIG. 7, the vertical axis denotes droplet speed [m/s] and the horizontal axis denotes sub drop cycle Ts of the drive waveform voltage signal which is expressed by an integral multiple of the natural vibration cycle Tc.

The characteristic of sample A (indicated by ○ in the figure) is natural vibration cycle Tc=6.08 μs; the characteristic of sample B (indicated by Δ in the figure) is natural vibration cycle Tc=6.20 μs; and the characteristic of sample C (indicated by X in the figure) is natural vibration cycle Tc=6.38 μs.

As known from FIG. 7, when the sub drop cycle Ts is in the range from 1.1 to 1.4 times the natural vibration cycle Tc, the droplet speed is almost equal among the three channels. More preferably, when the sub drop cycle Ts is in the range from 1.2 to 1.4 times the natural vibration cycle Tc, the droplet speed is uniform.

Figure 8A:
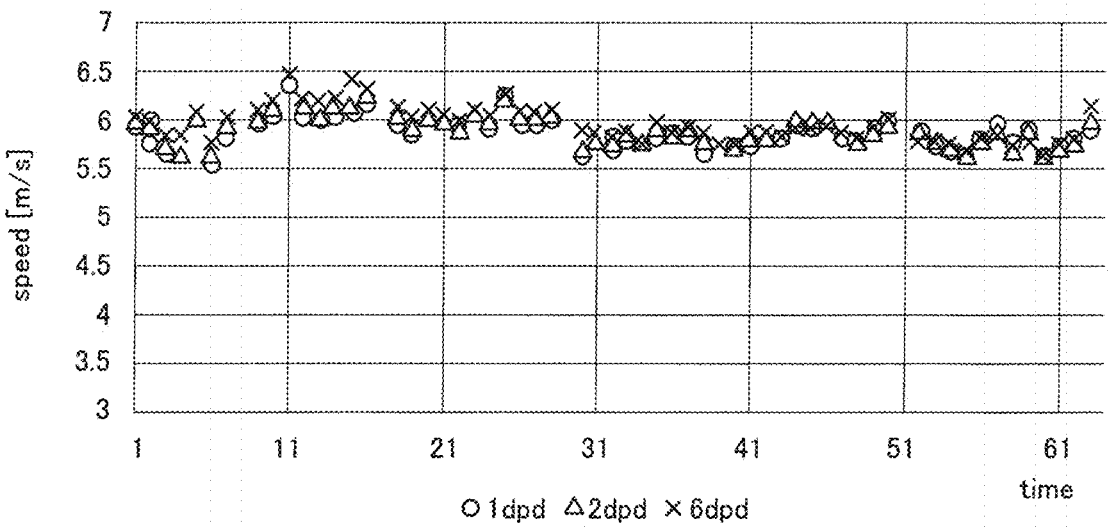
FIG. 8A and FIG. 8B are characteristic graphs which show speed distribution (FIG. 8A) according to the embodiment of the present invention and its comparative example (FIG. 8B).
Figure 8B:
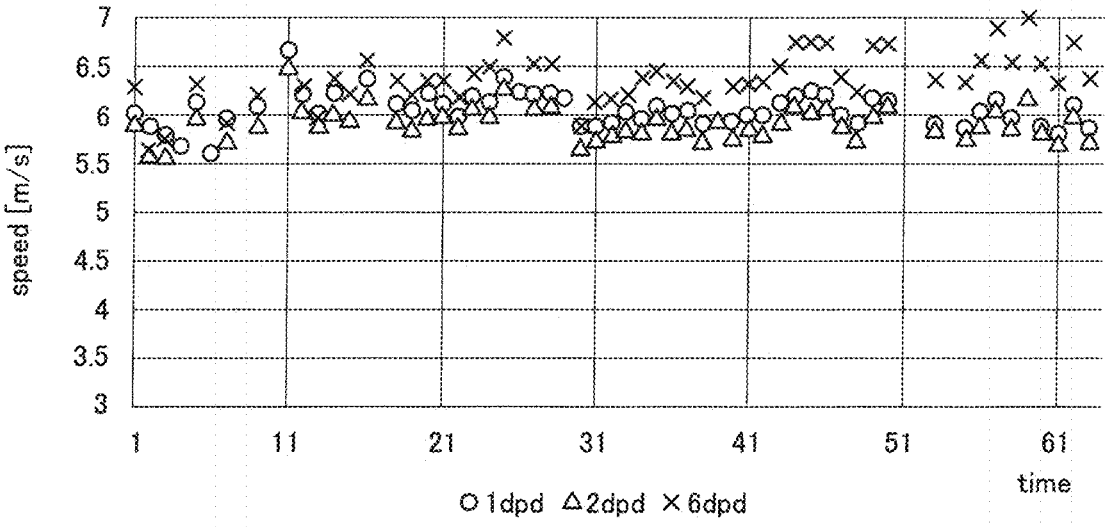

FIG. 8A and FIG. 8B show an example of the speed distribution characteristics in a plurality of channels. FIG. 8A shows the speed distribution in the case that the sub drop cycle Ts is 1.2 times the natural vibration cycle Tc of the inkjet head. Also, FIG. 8B shows the speed distribution in the case that the sub drop cycle Ts is 1.0 time the natural vibration cycle Tc of the inkjet head. In FIG. 8A and FIG. 8B, the vertical axis denotes droplet speed and the horizontal axis denotes time. This is a case that heads for 64 channels are driven and the discharge timing differs depending on the head position.

In FIG. 8A and FIG. 8B, ○, Δ, and X indicate cases that the discharge amount as the liquid amount is one time, three times, and six times the unit discharge amount, respectively.

In the case of the voltage waveforms shown in FIG. 8A in this embodiment, the droplet speed is almost constant among all the 64 channels regardless of the liquid amount. On the other hand, in the case of the conventional voltage waveforms shown in FIG. 8B, the droplet speed largely varies and particularly variation in the droplet speed is larger with the liquid amount of six times (characteristic indicated by X).

When the inkjet head droplet speed is almost equal among all the channels in this way, all the inkjet heads are driven with the same characteristics and the quality of recording is improved.

Here, referring to FIG. 9, an explanation will be given of the principle that the droplet speed is almost equal when the relationship between natural vibration cycle Tc and sub drop cycle Ts is $1.2Tc \leq Ts \leq 1.4Tc$.

Generally, in order to drive the inkjet head at higher speed and lower voltage efficiently, it is preferable that the waveform elements which form the drive signal should be waveforms which use the natural vibration cycle (resonance) of the system determined by the structure of the inkjet head including ink.

In order to use the resonance, the waveform elements should include an expansion pulse, a hold pulse and a contraction pulse in the order of mention and the hold pulse time duration should be adjusted so that the timing of application of the contraction pulse is just when the time of ½ the natural vibration cycle Tc has elapsed after application of the expansion pulse. When the expansion pulse and contraction pulse are applied to the ink inside the head pressure chamber, pressure waves of opposite phases are generated as shown in FIG. 9.

Figure 9:
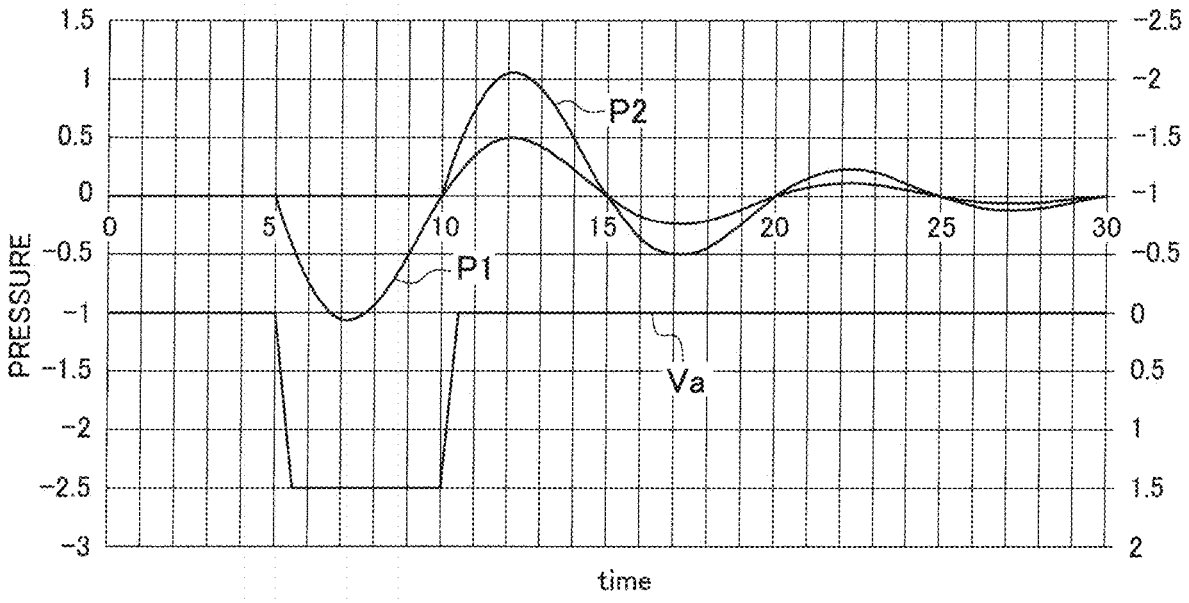
FIG. 9 is a characteristic graph which shows an example of pressure wave damping characteristics for explanation of the embodiment of the present invention.

The voltage waveform Va shown in FIG. 9 is the voltage applied to the actuator, characteristic P1 indicates the pressure wave speed by the expansion pulse, and characteristic P2 indicates the pressure wave speed by the contraction pulse.

These two pressure waves shown in FIG. 9 are damped vibrations which are damped due to the resistance caused by the ink flow path structure or other reason, while vibrating with the system natural vibration cycle.

Therefore, when the time from the start of application of the expansion pulse to the start of application of the contraction pulse is ½ Tc, the phases of the pressure waves become the same and the drive efficiency is maximized.

Since the vibration cycle and damping rate of the pressure waves depend on the flow path structure, if a subtle change in the flow path structure occurs due to fluctuations in the components or assembly of the inkjet head, both the natural vibration cycle and damping rate would change.

It is known from the equations below that the natural vibration cycle and damping rate change depending on the flow path structure.

When R denotes the resistance of the system, L denotes inertance and C denotes compliance, the resonance period Tc of the system is expressed by $Tc=2\pi\sqrt{(L*C)}$ and the Q value as an ordinary index indicating damping (when the Q value is smaller, damping is larger) is expressed by $Q=(2\pi/R)*\sqrt{(L/C)}$. In other words, when the compliance C is larger, the resonance period Tc is longer and the Q value is smaller. The resistance R does not influence the resonance period Tc but influences the Q value more largely than the inertance L and compliance C.

The influence of variations in the natural vibration cycle and damping rate on the droplet speed is ignorable when only one waveform element is used for drive. On the other hand, when a plurality of waveform elements are applied for multiple gradation drive, vibration cycle deviation and pressure wave damping are superimposed and thus speed variation would cause pixel displacement and influence the quality of printing.

Here, when the relationship between natural vibration cycle Tc and sub drop cycle Ts is $1.2Tc \leq Ts \leq 1.4Tc$, the droplet speed is almost uniformized as explained referring to FIG. 7, FIG. 8A and FIG. 8B.

As explained so far, according to the inkjet head recording device which adopts the inkjet head drive method according to this embodiment, variation in the natural vibration cycle among a plurality of inkjet heads is absorbed and all the inkjet heads are driven with the same characteristics so that the quality of recording can be improved.

[3. Variation]

For the drive voltage waveforms shown in FIG. 6A and FIG. 6B, the pulse width Tb of each waveform element is ½ the sub drop cycle Ts (Tb+Tb' in the example of FIG. 6A and FIG. 6B). On the other hand, the pulse width Tb of each waveform element is not limited to ½ the sub drop cycle Ts but it is arbitrarily determined in the range in which, after droplets are united, the speed of the united droplets is uniformized.

Figure 10:
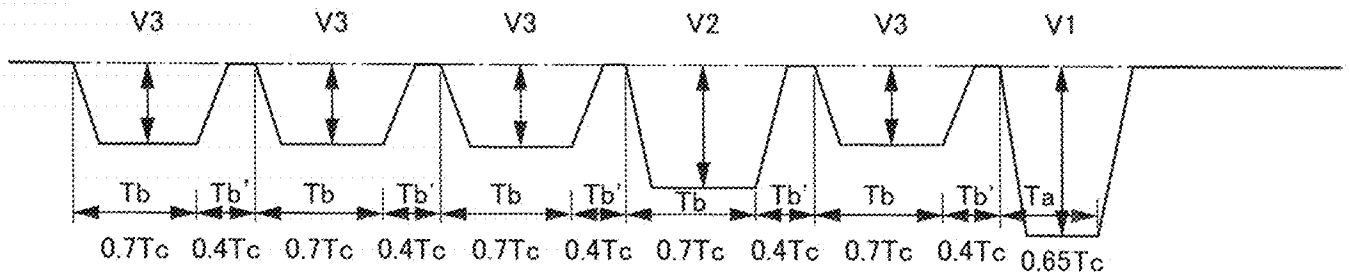
FIG. 10 is a waveform diagram which shows an example of a drive waveform (variation) according to the embodiment of the present invention.

For example, the drive voltage waveform may be as shown in FIG. 10. In the drive voltage waveform shown in FIG. 10, sub drop cycle Ts=1.1Tc, Tb=0.7Tc, and Tb'=0.4Tc.

The structure of the inkjet recording device 1 shown in FIGS. 1 and 2 is an example and the drive method according to this embodiment may be applied to an inkjet recording device with a different structure.

REFERENCE SIGNS LIST

1 . . . inkjet recording device,
10 . . . conveyor,
11 . . . drive roller,
12 . . . conveyance drive section,
20 . . . recording section,
21 . . . recording head,
211 . . . actuator,
212 . . . nozzle,
212*a* . . . opening,
213 . . . ink flow path,
22 . . . carriage,
23 . . . carriage rail,
24 . . . head drive section,
241 . . . drive waveform signal output section,
242 . . . analog converter,
243 . . . drive circuit,
244 . . . output selecting section,
25 . . . scan drive section,
40 . . . controller,
41 . . . CPU
42 . . . RAM,
43 . . . storage,
71 . . . operation display,
72 . . . communication section,
90 . . . bus

The invention claimed is:

1. An inkjet recording device comprising:

a plurality of inkjet heads having a nozzle for discharging ink;

a plurality of actuators which give a pressure change to the ink in the plural inkjet heads by a prescribed drive operation; and a drive section which generates a drive signal to discharge one droplet or discharge and unite a plurality of droplets for one pixel and applies the drive signal to each of the plural actuators, wherein the drive signal generated by the drive section includes a drive waveform comprising N number (N being an integer of at least 2) of drive waveform elements, when Tc is natural vibration cycle determined from a structure of the inkjet head, time Ts from a start point of the drive waveform to the start point of a subsequent drive waveform fulfills a relationship $1.1Tc \leq Ts \leq 1.4Tc$, a potential of a last drive waveform element is larger than a potential of other drive waveform elements, and a time period from a fall start of the voltage to the rise start for the drive waveform voltage signals except for the last drive waveform voltage signal is less than the same time period for the last drive waveform voltage signal.

2. The inkjet recording device according to claim 1, wherein the N number of the drive waveform elements is 5 or more.

3. The inkjet recording device according to claim 1, wherein when one droplet is discharged for one pixel, the drive waveform is outputted to a first cycle from a last cycle, when two droplets are discharged for one pixel, the drive waveform is outputted to the first and third cycles from the last cycle, and when M droplets ($M \geq 3$) are discharged for one pixel, the drive waveform is outputted to the first to M-th cycles from the last cycle.

4. The inkjet recording device according to claim 1, wherein the N number of drive waveform elements of the drive signal each include an expansion pulse to expand a volume of an inkjet head pressure chamber and a contraction pulse to contract the volume of the pressure chamber and discharge the ink from the nozzle, and for the last drive waveform element, a time period from a start point of the expansion pulse to the start point of the contraction pulse is 1.1 to 1.4 AL.

5. The inkjet recording device according to claim 1, wherein the N number of drive waveform elements of the drive signal each include an expansion pulse to expand a volume of an inkjet head pressure chamber and a contraction pulse to contract the volume of the pressure chamber and discharge the ink from the nozzle, and a drive pulse not to discharge is included at an end of the last drive waveform element.

6. An inkjet head drive method in which a plurality of actuators give a pressure change to ink by a prescribed drive signal so that a plurality of inkjet heads discharge the ink and the plural actuators are driven to discharge one droplet or discharge and unite a plurality of droplets for one pixel, wherein the drive signal includes a drive waveform comprising N number (N being an integer of at least 2) of drive waveform elements, and when Tc is natural vibration cycle determined from a structure of the inkjet head, time Ts from a start point of the drive waveform to the start point of a subsequent drive waveform fulfills a relationship $1.1Tc \leq Ts \leq 1.4Tc$, a potential of a last drive waveform element is larger than a potential of other drive waveform elements, and a time period from a fall start of the voltage to the rise start for the drive waveform voltage signals except for the last drive waveform voltage signal is less than the same time period for the last drive waveform voltage signal.

* * * * *